United States Patent [19]
Orwin

[11] Patent Number: 4,700,818
[45] Date of Patent: Oct. 20, 1987

[54] STRAP DEVICE FOR REINFORCING LUGGAGE AND THE LIKE

[76] Inventor: John P. Orwin, 31439 Alcona, Westland, Mich. 48185

[21] Appl. No.: 863,982

[22] Filed: May 16, 1986

[51] Int. Cl.[4] ..... A45C 13/30; B65D 63/00
[52] U.S. Cl. ..... 190/27; 190/26; 190/119; 190/127; 24/16 R; 24/17 A; 24/30.5 R; 294/155; 294/157
[58] Field of Search ..... 190/26, 27, 119, 109, 190/102, 120, 127; 294/150, 155, 157; 383/18; 150/52 J; 224/150, 917; 229/199; 24/16 R, 17 R, 17 A, 19, 24, 30.5 R

[56] References Cited

U.S. PATENT DOCUMENTS

| | | | |
|---|---|---|---|
| 142,565 | 9/1873 | Grinsted | 190/27 |
| 236,356 | 1/1881 | Pomeroy | 190/27 |
| 304,917 | 9/1884 | Dowlin . | |
| 316,384 | 4/1885 | Muncey | 190/27 |
| 356,528 | 1/1887 | Douglas | 190/27 |
| 380,431 | 4/1888 | Gabbs | 190/27 |
| 413,483 | 10/1889 | Bays | 190/27 |
| 495,151 | 4/1893 | Desmarais | 190/27 |
| 602,496 | 4/1898 | Brunner, Jr. | 190/27 |
| 651,283 | 6/1900 | Waxman | 190/27 |
| 652,473 | 6/1900 | Cole | 190/27 |
| 656,707 | 8/1900 | Welshe | 190/26 |
| 765,895 | 7/1904 | King, Jr. | 190/27 |
| 790,748 | 5/1905 | Rangnow | 190/27 |
| 841,620 | 1/1907 | Buchanan | 190/27 |
| 902,695 | 11/1908 | Staley | 190/27 |
| 941,969 | 11/1909 | Williams | 190/26 |
| 1,171,678 | 2/1916 | Trotter . | |
| 1,203,442 | 10/1916 | Wister | 190/27 |
| 1,281,586 | 10/1918 | Kolibas . | |
| 1,353,814 | 9/1920 | Emery | 190/27 |
| 1,526,839 | 2/1925 | Dempsey | 190/26 |
| 1,628,812 | 5/1927 | Shwayder . | |
| 1,726,627 | 9/1929 | Munch . | |
| 2,172,336 | 7/1955 | Casselman | 383/18 X |
| 2,210,351 | 8/1940 | Westendorf | 190/119 |
| 2,487,596 | 11/1949 | Sackstein | 150/26 |
| 2,584,048 | 1/1952 | Ramsey | 190/119 |
| 2,711,234 | 6/1955 | Rubens | 190/26 |
| 3,372,438 | 3/1968 | Rinecker | 24/16 |
| 3,955,656 | 5/1976 | Kashinski | 190/26 X |
| 4,061,259 | 12/1977 | Hurst | 190/115 X |
| 4,127,223 | 11/1978 | Uchin | 294/150 |
| 4,261,448 | 4/1981 | Myers et al. | 190/27 |
| 4,531,661 | 7/1985 | Santy | 224/917 X |

*Primary Examiner*—Stephen Marcus
*Assistant Examiner*—Sue A. Weaver
*Attorney, Agent, or Firm*—Price, Heneveld, Cooper, DeWitt & Litton

[57] ABSTRACT

A strap device for luggage, bags, cartons or the like to prevent the luggage from opening when subjected to rough handling. The strap device includes a pair of straps which encircle the luggage and pass on either side of a handle on the luggage. A pair of cross straps are secured between the encircling straps and confine and surround the handle such that the device cannot be slid off or pulled off the luggage. No additional connection or attachment between the strap device and luggage is required. Various mechanical and hook and loop fasteners can be used to secure and tighten the encircling straps.

22 Claims, 6 Drawing Figures

STRAP DEVICE FOR REINFORCING LUGGAGE AND THE LIKE

BACKGROUND OF THE INVENTION

This invention relates to devices for reinforcing luggage, bags, cartons and the like and, more particularly, to a strap device adapted to be secured around a piece of luggage, a bag or a carton to provide additional protection against unexpected opening. The strap device is uniquely constructed to be retained on the luggage or bag by contact with existing structure on the bag without requiring any additional connection or attachment.

A common problem encountered by travelers worldwide is the rough handling of baggage on airplanes, trains, ships or buses. Rough handling often causes unintended opening of the luggage or causes a portion of the luggage to burst open and expose the contents to dirt or even destruction. Accordingly, many travelers desire appropriate forms of reinforcement for such luggage to prevent the occurrence of these problems.

In the past, various types of reinforcing straps have been proposed for use with trunks, luggage or other bags. Many have included one or more straps encircling the bag. Others have included rigid strips or other structure to which the straps are secured. Yet others have required the use of separate retaining straps fitted about the reinforcing straps at various locations around the bag or luggage to hold the reinforcing straps in place on the luggage or trunk. In many cases, this required the addition of attaching or connecting members to prevent the reinforcement from being removed or the bag opened. Of course, the addition of such connecting structures added expense, made the use of any reinforcing device more time consuming and cumbersome, and could even create additional damage during rough handling should such attaching members be torn from the luggage.

Therefore, the need was apparent for a simple, durable, reinforcing device for use with luggage, bags, cartons and the like which could accommodate various sizes of luggage or bags, be retained on the luggage or bag without the need for additional connecting members, and yet prevent the luggage or bag from unintended opening under a wide range of conditions. The present invention was devised in recognition of and as a solution for these and other problems.

SUMMARY OF THE INVENTION

Accordingly, the present invention provides a strap device for luggage, bags, cartons or the like which prevents the luggage from opening when subjected to rough handling but is easily used with varying sizes of luggage without the requirement of additional connection or attachment members to maintain the strap device in position.

In one form, the invention is a strap device including a pair of first, spaced strap means which encircle a piece of luggage and extend along opposed sides of a protruding handle on the luggage. The strap device also includes a pair of cross straps secured at spaced positions and extending between the first strap means for holding the first strap means together. The cross strap means are adapted to extend along a second pair of opposed sides of the protruding handle on the luggage. The first strap and cross strap means are preferably formed from flexible, stretch resistant material. Securing means are provided on at least one end of the first strap means for securing the strap means together to encircle and reinforce the luggage. The cross strap means and portions of the first strap means between the spaced cross strap means together define confining means for surrounding and receiving the protruding handle on the luggage to prevent the strap device from sliding or being pulled off the luggage when the first strap means are secured around the luggage with the securing means.

Preferably, the securing means may include mechanical securing devices such as a pair of pivotal D-rings through which the opposite end of the strap may be secured. In addition, the opposite end of the strap may include hook and loop-type fasteners such as Velcro (trademark) fastener material for securing the free end to another portion of the strap after securement with the securing means.

The first strap means and cross strap means are preferably formed from woven fabric straps generally equal in length with the cross straps being at right angles to the first straps. If desired, an additional third or other cross straps may be included at a position spaced from the first pair of cross straps for aiding the retention of the first straps together.

The invention also encompasses the combination of the strap device and a piece of luggage wherein the strap device is sized to prevent sliding or pulling off the luggage when the confining area around the handle engages the handle. The first straps may also be spaced to engage feet on the luggage to help prevent removal.

Accordingly, the present invention provides numerous advantages over prior known luggage reinforcing devices. The device is simple yet strong and durable and may easily accommodate various sizes of bags. The device may be easily placed around a bag and secured with the confining means surrounding a handle such that the device cannot be pulled or slid from the luggage without loosening the securing means. No additional connectors or attachments between the luggage and the device are necessary to keep it in position on the luggage even during rough handling. The device is also sufficiently small and flexible to fold up and place within a bag when not in use. In addition, the device does not require great force for securement around a bag or luggage piece and may be quickly and easily installed and removed.

These and other objects, advantages, purposes and features of the invention will become more apparent from a study of the following description taken in conjunction with the drawings.

DESCRIPTION OF THE PREFERRED EMBODIMENTS

Figure 1:
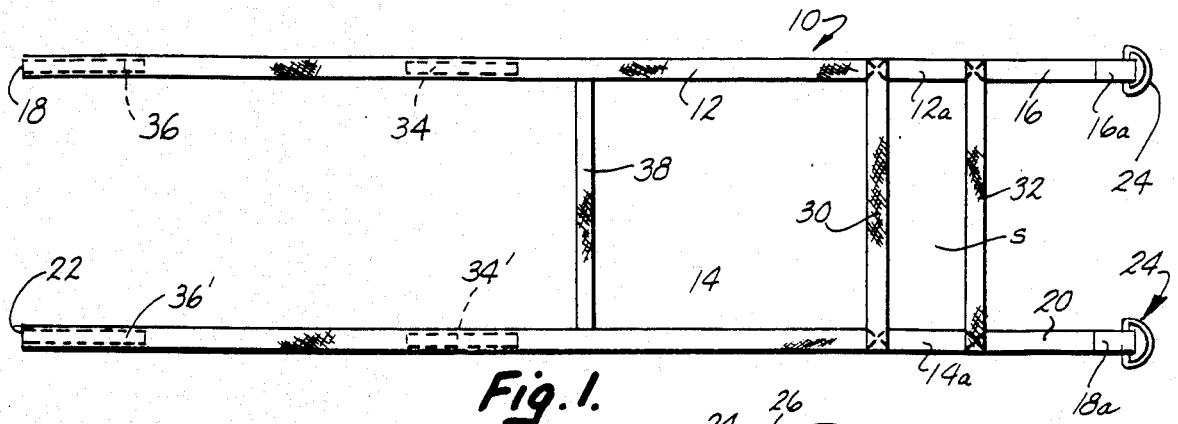
FIG. 1 is a plan view of a preferred embodiment of the strap device of the present invention.
Figure 2:
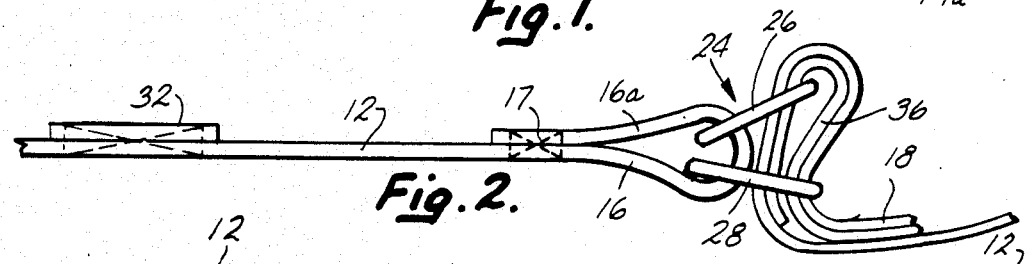
FIG. 2 is a fragmentary, side elevation of one portion of the strap device of FIG. 1.
Figure 3:
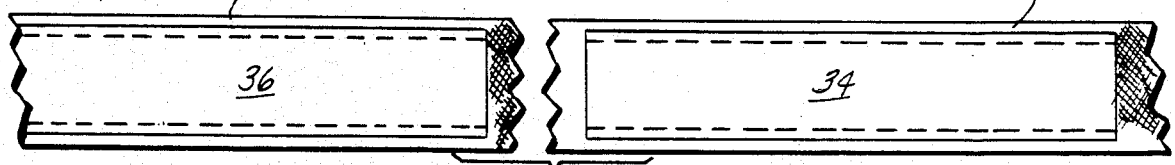
FIG. 3 is a broken plan view of another portion of one of the straps of the strap device of FIGS. 1 and 2.

Referring now to the drawings in greater detail, FIGS. 1–3 illustrate a first embodiment 10 of the strap device of the present invention including a pair of parallel straps 12, 14 adapted to encircle and reinforce a piece of luggage, a bag, a carton or the like. Each strap 12, 14 includes opposed ends 16, 18 and 20, 22. A mechanical securing device 24 is mounted at one end 16, 20 of each strap 12, 14 respectively for securing the opposite free end of the straps 18, 20 as will be explained more fully below. Straps 12, 14 are generally equal in length and coterminous with one another. They are typically formed from stretch resistant, woven fabric or leather straps. Straps 12, 14 have a length sufficient to wrap around the luggage or bag desired to be reinforced with the device 10 plus an additional length allowing proper use of the securing members at the end of the straps when placed around a bag.

In the preferred embodiment, the mechanical securing devices 24 secured at ends 16, 20 of straps 12, 14 include a pair of pivotal, stainless steel, chrome plated or other metal or durable plastic D-rings 26, 28. D-rings 26, 28 are retained by looping the end 16*a* or 18*a* of strap 12 or 14 therethrough as shown in FIG. 2 and doubling that end back upon itself for securement by stitching 17 or the like. The loop in end 16*a* or 18*a* is sufficiently large to allow the D-rings 26, 28 to be loose and freely pivotable within the loop.

Secured between the parallel straps 12, 14 at spaced positions near ends 16, 20 are a pair of reinforcing cross straps 30, 32 formed from the same material from which straps 12, 14 are made. Straps 30, 32 extend at a right angle to straps 12, 14, are equal in length to maintain straps 12, 14 in parallel position, are spaced apart a distance less than the spacing of straps 12, 14 in order to better confine the handle of a luggage piece as explained below, and are preferably formed from stretch resistant, woven, fabric material or leather. Preferably, straps 30, 32 are sewn to straps 12, 14 although they could also be secured with other fasteners such as rivets or be adhered with a strong adhesive.

As will be seen from FIG. 1, the combined straps 12, 14, 30, 32 define a rectangular enclosure or space S through which the handle of a piece of luggage is adapted to be received when the device is placed on such luggage. The cross straps 30, 32 and the portions of portions 12*a*, 14*a* of straps 12, 14 between the ends of cross straps 30, 32 define such rectangular opening and provide portions which will engage the handle of the luggage to prevent the strap device from slipping or being pulled off the luggage during rough handling as explained below.

Referring now to FIGS. 2 and 3, when it is desired to secure the strap device around a piece of luggage, each of the straps 12, 14 is formed into a loop with the free end 18 being passed completely through D-rings 26, 28 and then looped back through the lower D-rings 28 in the fashion shown in FIG. 2. The free end may then be pulled away from the D-rings to cause the strap to be securely held between the D-rings. In order to secure the free ends 18, 24 of the strap to prevent it from pulling back through the D-rings or moving back and forth across straps 12, 14, sections of a hook and loop-type fastening fabric such as Velcro (trademark) fastening fabric are secured on straps 12, 14. The Velcro (trademark) fastening fabric or other hook and loop-type fastening fabric is secured immediately adjacent ends 18, 22 in positions 36, 36' and in spaced positions 34, 34' approximately one-half way between ends 18, 22 and cross strap 30 all on the same side of each strap. Accordingly, after end 18 or 22 is secured through D-rings 26, 28, that end is pulled down along strap 12 or 14 until it is aligned with the position of the opposite hook and loop fastener fabric piece at position 34 or 34'. The two sections may then be pressed together with end 18 or 22 being securely held to another portion of strap 12 or 14 to prevent the loosening of the mechanical securing device 24.

Figure 6:
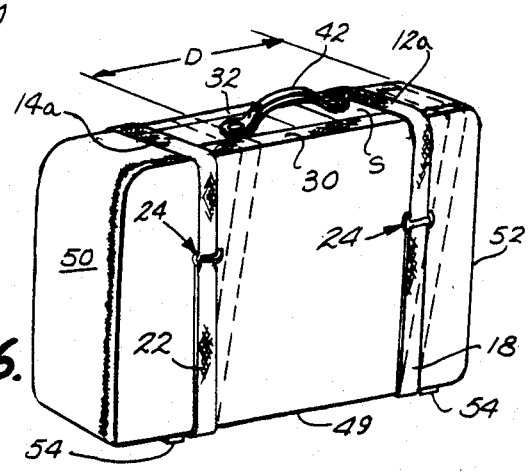
FIG. 6 is a perspective view of the luggage piece with the strap device completely installed thereon.

If desired, an additional cross strap 38 (shown in phantom in FIG. 1) may be included at a position spaced from cross strap 30 or 32 to provide additional help in holding straps 12, 14 in position. Typically, cross strap 38 may be positioned at the bottom of a luggage piece or bag while cross straps 30, 32 are positioned at the top for surrounding the top or main carrying handle of the luggage piece. In addition, the lateral spacing of straps 12, 14 as determined by the length of straps 30, 32 and 38 is preferably slightly less than the space between any feet 54 on the bottom 49 of a luggage piece or bag (FIG. 6). Straps 12, 14 will thus fit inside such feet and, together with the confining of the handle with strap portions 12*a*, 14, 30, 32, will also help prevent removal of the strap device from the luggage.

Figure 4:
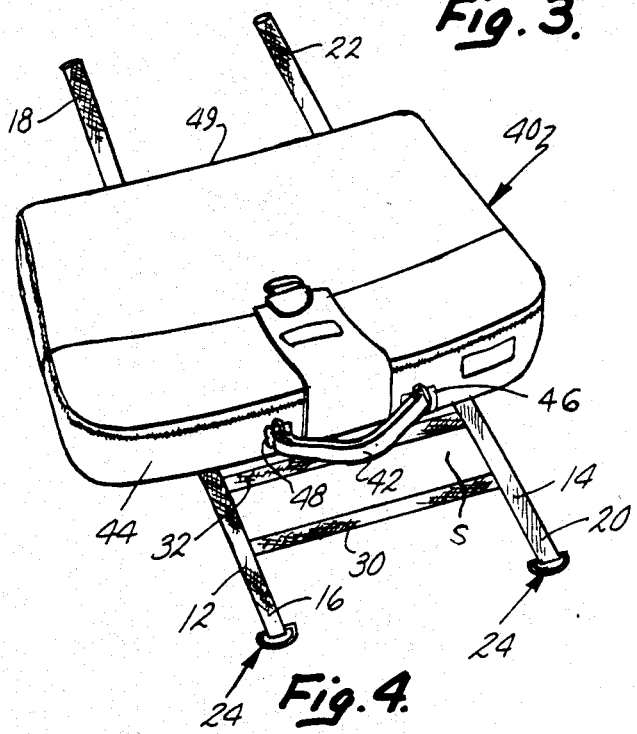
FIG. 4 is a perspective view of the strap device positioned for installation on a typical piece of luggage and shown immediately prior to installation.
Figure 5:
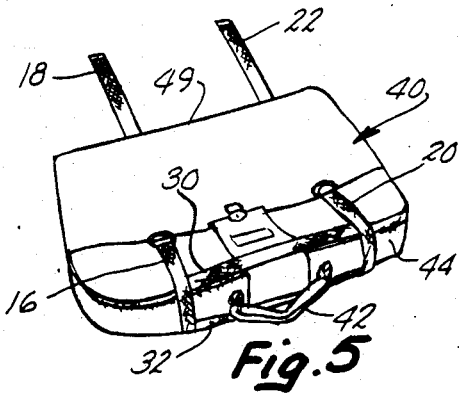
FIG. 5 is a perspective view of the luggage piece and strap device of FIG. 4 with the strap device partially installed on the piece of luggage.

In reference to FIGS. 4–6, installation and use of the strap device 10 on a typical luggage piece 40 will be understood. As is best seen in FIG. 4, luggage piece 40 includes a protruding rigid or semi-rigid handle 42 pivotally or otherwise secured to the top surface 44 of the luggage via securing devices 46, 48. The luggage is laid over the extended strap device 10 which has been previously positioned on a flat surface such that one of the larger sides of the luggage 40 is positioned across straps 12, 14. Top surface 44 is substantially parallel to straps 30, 32. Handle 42 of luggage piece 40 is preferably positioned immediately over rectangular opening S defined by straps 12*a*, 14*a*, 30, 32 as shown in FIG. 4. Free ends 18, 22 of straps 12, 14 extend past the bottom surface 49 of the luggage.

Next, ends 16, 20 of the strap device are wrapped up and around top surface 44 of the luggage until they are directed laterally across the zipper or other closure on the bag and back toward bottom surface 49 and strap ends 18, 22. Care should be taken to assure that straps 12, 14 remain flat and are not twisted. Thereafter, strap ends 18, 22 are wrapped upwardly over bottom surface 49 and toward ends 16, 20 to encircle the luggage. Ends 16, 20 may then be sequentially pulled snug and tight around the bag and secured via mechanical securing devices 24 including D-rings 26, 28 in the manner described above. Free ends 18, 22, including hook and loop fastener portions 36, 36', are then doubled back upon themselves and engaged with the opposite hook and loop fastener portions 34, 34' to complete the attachment of the device to the piece of luggage. Strap ends 18, 22 preferably fit snugly around the bag but need not be overly tightened to compress or crush the luggage piece.

As shown in FIG. 6, when installed in the described manner, straps 12, 14 extend substantially parallel to the end surfaces 50, 52 of the luggage and completely encircle the luggage to reinforce it and prevent it from unintended opening. In addition, strap portions 30, 32 and 12*a*, 14*a* confine and surround handle 42 and prevent strap device 10 from either rotating around the bag or being pulled laterally off an end of the bag.

As also shown in FIG. 6, the spacing between straps 12, 14 is preferably chosen to be less than the distance D between one end of the handle 42 and the opposite end surface 52 of the bag. Hence, even if the strap device is pulled laterally toward end 52 as shown in phantom in FIG. 6, strap portion 14*a* will engage handle 42 or its securing attachment 46 to prevent the strap device from being moved farther toward that edge and off the bag. Such effect is aided by engagement of portions of straps 12, 14 opposite top surface 44 and handle 42 on the inside surfaces of any feet 54 provided on the bottom surface 49 of the bag as shown in FIG. 6. Accordingly, the strap device is retained properly in position on the bag without the need for additional securing devices or attachment straps. It may thus be used with virtually any bag, carton or piece of luggage without special modification. In addition, the flexible nature of the preferred woven straps of the device allows it to be compactly stored within the bag when reinforcement is unnecessary.

Preferably, straps 12, 14, 30, 32 and 38 may be formed from three-quarters to one-half inch wide cotton, nylon or leather straps using one inch metal D-rings with half inch Velcro fastener strips secured at positions 36, 36', 34 and 34'. Of course, the size and thickness of the straps may be increased depending on the size of the luggage or bag to be reinforced. Likewise, the length and spacing of the straps may be adjusted according to the size of the bag or luggage to be reinforced. Also, additional cross straps 38 may be added to provide additional reinforcement preventing straps 12, 14 from pulling apart when in position on the bag.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A strap device for reinforcing luggage, bags, cartons or the like comprising:

a pair of first, spaced strap means for encircling a piece of luggage or the like, said first strap means adapted to extend along a first pair of opposed sides of a protruding handle on a luggage piece;

a pair of cross strap means secured at spaced positions on and extending between said first strap means for holding said first strap means together, said cross strap means adapted to extend along a second pair of opposed sides fo the protruding handle of a luggage piece or the like;

each of said first strap means and cross strap means being formed from flexible, stretch resistant material;

securing means on one end of each of said first strap means for securing the respective ends of said first strap means to one another to encircle and reinforce a luggage piece or the like; engaging means on the opposite end of each of said first strap means for engaging said securing means on said one end to form each of said first strap means into a closed loop for encircling the luggage without said securing means or engaging means engaging said cross strap means;

said cross strap means and the portions of said first strap means between said spaced cross strap means forming confining means for surrounding and receiving therein the protruding handle on the luggage piece or the like to prevent said strap device from sliding or being pulled off the luggage piece when said first strap means are secured around the luggage piece with said securing means and engaging means.

2. A strap device for reinforcing luggage, bags, cartons or the like comprising;

a pair of first, spaced strap means for encircling a piece of luggage or the like, said first strap means adapted to extend along a first pair of opposed side of a protruding handle on a luggage piece;

a pair of croas strap means secured at spaced positions on and extending between said first strap means for holding said first strap means together, said cross strap means adapted to extend along a second pair of opposed sides of the protruding handle of a luggage piece or the like;

each of said first strap means and cross strap means being formed from flexible, stretch resistant material;

securing means on at least one end of each of said first strap means for securing the respective ends of said first strap means to one another to encircle and reinforce a luggage piece or the like; said securing means including a mechanical securing device; the opposite ends of said first strap means including hook and loop fastener means for securing said opposite ends to another portion of said first strap means after passing through said mechanical securing device; said cross strap means and the portions of said first strap means between said spaced cross strap means forming confining means for surrounding and receiving therein the protruding handle on the luggage piece or the like to prevent said strap device from sliding or being pulled off the luggage piece when said first strap means are secured around the luggage piece with said securing means.

3. The strap device of claim 2 wherein said mechanical securing device on each first strap means includes a pair of D-rings pivotally secured at said one end of each first strap means.

4. A strap device for reinforcing luggage, bags, cartons or the like comprising:

a pair of first, spaced strap means for encricling a piece of luggage or the like, said first strap means adapted to extend along a first pair of opposed sides of a protruding handle on a luggage piece;

a pair of cross strap means secured at spaced positions on and extending between said first strap means for holding said first strap means together, said cross strap means adapted to extend along a second pair of opposed sides of the protruding handle of a luggage piece or the like;

each of said first strap means and cross strap means being formed from flexible, stretch resistant material;

securing means on at least one end of each of said first strap means for securing the respective ends of said first strap means to one another to encircle and reinforce a luggage piece or the like; the opposite end of each of said first strap means including second securing means for securing said opposite end to another portion of said first strap means after securing with the first of said securing means; said cross strap means and the portions of said first strap means between said spaced cross strap means forming confining means for surrounding and receiving therein the protruding handle ont he luggage piece or the like to prevent said strap device from sliding or being pulled off the luggage piece when said first strap means are secured around the luggage piece with said securing means.

5. A strap device of claim 4 wherein said second securing means include hook and loop fastener means for securing said opposite end of said first strap means to another portion of said first strap means, a portion of said fastener means secured at a position spaced from another portion of said fastener means on the same side of each of said first strap means.

6. The strap device of claim 1 including an additional cross strap means extending between said first strap menas at a position spaced from said pair of cross strap means for aiding the retention of said first strap means together.

7. The strap device of claim 1 wherein said first strap means include a pair of woven fabric straps of generally equal length and being generally coterminous with one another.

8. A strap device for reinforcing luggage, bags, cartons or the like comprising:

a pair of first, spaced strap means for encircling a piece of luggage or the like, said first strap means adapted to extend along a first pair of opposed sides of a protruding handle on a luggage piece;

a pair of cross strap means secured at spaced positions on and extending between said first strap means for holding said first strap means together, said cross strap means adapted to extend along a second pair of opposed sides of the protruding handle of a luggage piece or the like;

each of said first strap means and cross strap means being formed from flexible, stretch resistant material;

securing means on at least one end of each of said first strap means for securing the respective ends of said first strap means to one another to encricle and reinforce a luggage piece or the like;

said cross strap means and the portions of said first strap means between said spaced cross strap means forming confining means for surrounding and receiving therein the protruding handle on the luggage piece or the like to prevent said strap device from sliding or being pulled off the luggage piece when said first strap means are secured around the luggage piece with said securing means;

said first strap means including a pair of woven fabric straps of generally equal length and being generally coterminous with one another; said cross strap means including a pair of woven fabric straps of generally equal length extending at a right angle to said first straps.

9. The strap device of claim 8 wherein said cross straps are spaced apart along said first straps a distance less than the distance by which said parallel first straps are spaced apart.

10. A strap device for reinforcing luggage, bags, cartons or the like comprising:

a pair of parallel first straps, each first strap being formed from flexible stretch resistant material, said first straps being generally of equal length and spaced from one another a predetermined first distance;

a pair of parallel cross straps extending at right angles to and secured in fixed positions between said first straps, each of said cross straps being formed from flexible, stretch resistant material, said cross straps being spaced from one another less than said first distance;

securing means on at least one end of each of said first straps for securing the ends of said respective first straps together such that each forms a closed loop reinforcement adapted to encircle a piece of luggage or the like;

said cross straps and the portions of said first straps between said cross straps forming a confining means for receiving therein a protruding handle from said luggage piece or the like and preventing removal of said strap device from said piece of luggage when said first straps are secured around said luggage with said securing means.

11. The strap device of claim 10 wherein said securing means include a pair of D-rings pivotally secured to one end of each of said first straps, the opposite end of each first strap adapted to be received through and held by said D-rings to encircle a luggage piece or the like.

12. The strap device of claim 11 wherein each of said opposite ends of said first straps include one portion of a hook and loop-type fastener, another portion of said fastener being secured to said each of said first straps at a position spaced from said opposite end whereby said opposite ends may be secured to other portions of said first straps after passing through said D-rings

13. The strap device of claim 12 wherein each of said first straps and cross straps is formed from woven fabric material.

14. The combination of a piece of luggage of the type including a handle protruding a from one surface thereof and a strap device for reinforcing said luggage against opening, said strap device comprising:

a pair of first, spaced strap means for encircling said luggage, said first strap means adapted to extend along a first pair of opposed sides of a protruding handle on said luggage piece;

a pair of cross strap means secured at spaced positions on and extending between said first strap means for holding said first strap means together, said cross strap means adapted to extend along a second pair of opposed sides of said protruding handle;

each of said first strap means and cross strap means being formed from flexible, stretch resistant material;

securing means on one end of each of said first strap means for securing the respective ends of said first strap means to one another to encircle and reinforce said luggage piece; engaging means on the opposite end of each of said first strap means for engaging said securing means on said one end to form each of said first strap means into a closed loop for encircling said luggage without said securing means or engaging means engaging said cross strap means;

said cross strap means and the portions of said first strap means between said spaced cross strap means forming confining means for surrounding and receiving therein said protruding handle on said luggage piece to prevent said strap device from sliding or being pulled off said luggage piece when said first strap means are secured around said luggage piece with said securing means and engaging means.

15. The combination of claim 14 wherein said securing means include a pair of D-rings pivotally secured at said one end of each first strap means.

16. The combination of a piece of luggage of the type including a handle protruding from one surface thereof and a strap device for reinforcing said luggage against opening, said strap device comprising:

a pair of first, spaced strap means for encircling said luggage, said first strap means adapted to extend along a first pair of opposed sides of a protruding handle on said luggage piece;

a pair of cross strap means secured at spaced positions on and extending between said first strap means for holding said first strap means together, said cross strap means adapted to extend along a second pair of opposed sides of said protruding handle;

each of said first strap means and cross strap means being formed from flexible, stretch resistant material;

securing means on at least one end of each of said first strap means for securing the respective ends of said first strap means to one another to encircle and reinforce said luggage piece;

the opposite end of each of said first strap means including second securing means for securing said opposite end to another portion of said first strap means after securing with the first of said securing means;

said cross strap means and the poritons of said first strap means between said spaced cross strap means forming confining means for surrounding and receiving therein said protruding handle on said luggage piece to prevent said strap device from sliding or being pulled off said luggage piece when said first strap means are secured around said luggage piece with said securing means.

17. The combination of claim 16 wherein said second securing means include hook and loop fastener means for securing said opposite end of said first strap means to another portion of said first strap means, a portion of said fastener means secured at a position spaced from another portion of said fastener means on the same side of each of said first strap means.

18. The combination of claim 14 wherein said first strap means include a pair of woven fabric straps of generally equal length and being generally parallel to and coterminous with one another.

19. The combination of a piece of luggage of the type including a handle protruding from one surface thereof and a strap device for reinforcing said luggage against opening, said strap device comprising:

a pair of first, spaced strap means for encircling said luggage, said first strap means adapted to extend along a first pair of opposed sides of a protruding handle on said luggage piece;

a pair of cross strap means secured at spaced positions on and extending between said first strap means for holding said first strap means together, said cross strap means adapted to extend along a second pair of opposed sides of said protruding handle;

each of said first strap means and cross strap means being foremd from flexible, stretch resistant material;

said first strap means including a pair of woven fabric strap s of generally equal length and being generally parallel to and coterminous with one another; said cross strap means including a pair of woven fabric straps of generally equal length extending at a right angle to said first straps;

securing means on at least one end of each of said first strap means for securing the respective ends of said first strap means to one another to encircle and reinforce said luggage piece;

said cross strap means and the poritons of said first strap means between said spaced cross strap means forming confining means for surrounding and receiving therein said protruding handle on said luggage piece to prevent said strap device from sliding or being pulled off said luggage piece when said first strap means are secured around said luggage piece with said securing means.

20. The combination of claim 19 wherein said cross straps are spaced apart along said first straps a distance less than the distance by which said parallel first straps are spaced apart.

21. The combination of a piece of luggage of the type including a handle protruding from one surface thereof and a strap device for reinforcing said luggage against opening, said strap device comprising:

a pair of first, spaced means for encircling said luggage, said first strap means adapted to extend along a first pair of opposed sides of a protruding handle on said luggage piece;

a pair of cross strap means secured at spaced positions on and extending between said first strap means for holding said first strap means together, said cross strap means adapted to extend along a second pair of opposed sides of said protruding handle;

each of said first strap means and cross strap means being formed from flexible, stretch resistant material;

securing means on at least one end of each of said first strap means for securing the respective ends of said first strap means to one another to encircle and reinforce said luggage piece; said cross strap means and the portions of said first strap means between said spaced cross strap means forming confining means for surrounding and receiving therein said protruding handle on said luggage piece to prevent said strap device from sliding or being pulled off said luggage piece when said first strap means are secured around said luggage piece with said securing means;

the distance between said first strap means being equal to or less than the distance from one side of said handle to at least the opposite edge of the surface of said luggage from which said handle protrudes.

22. The combination of claim 14 wherein the distance between said first strap means is less than the distance between any feet on said luggage, said first strap means engaging the inner surfaces of such feet to prevent removal from said luggage.

* * * * *

UNITED STATES PATENT AND TRADEMARK OFFICE

CERTIFICATE OF CORRECTION

PATENT NO. : 4,700,818

DATED : October 20, 1987

INVENTOR(S) : John P. Orwin

It is certified that error appears in the above-identified patent and that said Letters Patent is hereby corrected as shown below:

Column 5, line 55:

"fo" should be --of--

Column 6, line 16:

"side" should be --sides--

Column 6, line 18:

"croas" should be --cross--

Column 6, line 50:

"encricling" should be --encircling--

Column 7, line 6:

"ont he" should be --on the--

Column 7, line 20:

"menas" should be --means--

Column 7, line 44:

"encricle" should be --encircle--

UNITED STATES PATENT AND TRADEMARK OFFICE

CERTIFICATE OF CORRECTION

PATENT NO. : 4,700,818

DATED : October 20, 1987 PAGE 2 OF 2

INVENTOR(S) : John P. Orwin

It is certified that error appears in the above-identified patent and that said Letters Patent is hereby corrected as shown below:

Column 8, line 37:

After "protruding" delete "a"

Column 9, line 31:

"poritons" should be --portions--

Column 10, line 2:

"foremd" should be --formed--

Column 10, line 5:

"strap s" should be --straps--

Column 10, line 14:

"poritons" should be --portions--

Signed and Sealed this

Third Day of May, 1988

*Attest:*

*Attesting Officer*

DONALD J. QUIGG

*Commissioner of Patents and Trademarks*